US008469072B1

(12) United States Patent
Baca

(10) Patent No.: US 8,469,072 B1
(45) Date of Patent: Jun. 25, 2013

(54) TAPE DISPENSER WITH PAPER CUTTER

(76) Inventor: Orlando Baca, Tuba City, AZ (US)

( * ) Notice: Subject to any disclaimer, the term of this patent is extended or adjusted under 35 U.S.C. 154(b) by 873 days.

(21) Appl. No.: 12/418,487

(22) Filed: Apr. 3, 2009

Related U.S. Application Data

(60) Provisional application No. 61/123,743, filed on Apr. 11, 2008.

(51) Int. Cl.

| | |
|---|---|
| ***B29C 65/00*** | (2006.01) |
| ***B32B 37/00*** | (2006.01) |
| ***B32B 38/10*** | (2006.01) |
| ***B32B 38/04*** | (2006.01) |

(52) U.S. Cl.
USPC ..... 156/523; 156/524; 156/525; 156/579; 156/527; 156/577; 7/158; 7/160; 30/123; 30/124; 225/39

(58) Field of Classification Search
USPC ..... 156/523, 524, 525, 527, 577, 579, 156/526; 7/160, 158; 30/124, 123; 225/39
See application file for complete search history.

(56) References Cited

U.S. PATENT DOCUMENTS

| | | | | |
|---|---|---|---|---|
| 1,218,798 | A * | 3/1917 | Nelson | 7/135 |
| 2,924,365 | A * | 2/1960 | Dahlquist | 225/47 |
| 5,168,629 | A * | 12/1992 | Willard | 30/231 |
| 7,805,842 | B2 * | 10/2010 | Bland | 30/123 |

* cited by examiner

*Primary Examiner* — Linda L Gray
(74) *Attorney, Agent, or Firm* — Schmeiser, Olsen & Watts LLP

(57) ABSTRACT

A tape dispenser with paper cutting tool is disclosed. The tape dispenser with paper cutter includes a blade and paper guide tine integrally formed with a tape dispenser housing. Additional capabilities can be added such as a ribbon curler and a glue stick. The tool can be used for multiple purposes when wrapping gifts, craft projects, or performing other office or home tasks.

12 Claims, 9 Drawing Sheets

TAPE DISPENSER WITH PAPER CUTTER

CROSS REFERENCE TO RELATED APPLICATION

This application claims priority to U.S. Provisional Patent Application to Ralph Orlando Baca Jr. entitled "2 in 1 tape dispensing/paper cutter a.k.a. "the elf"," U.S. Ser. No. 61/123,743 filed Apr. 11, 2008, the disclosure of which are hereby incorporated entirely herein by reference.

BACKGROUND OF THE INVENTION

1. Technical Field

This invention relates generally to office and household stationery tools, and particularly to tools used for cutting and attaching paper used in wrapping gifts and craft projects.

2. State of the Art

Wrapping a gift requires the use of several different tools, including adhesive tape, scissors, glue, etc. These tools are separate and the task of wrapping a present requires switching from one tool to the next. First, to cut wrapping paper the scissors are picked up and the paper is cut, and the scissors are put down. Then to tape the wrapping paper the tape is picked up, tape is dispensed and placed, and the tape is put down. More cutting may be needed so scissors are picked up again to make a cut and then put down. The tools required are individual and perform one task at a time. Another similar task requiring multiple needs is scrapbooking. Items such as paper and photos are gathered and need to be formed and attached into the scrapbook. Multiple tools are used and it takes time to find each tool separately as it is needed. The individual tools are often not optimum for the job to be accomplished.

Accordingly, in performing tasks such as present wrapping, scrapbooking, card making and other craft projects, much time and effort is spent in switching between tools, resulting in less time to complete projects. Further, the tools used are often misplaced during work on various projects.

Therefore, there is a need in the field of craft projects for an improved tool capable of accomplishing paper cutting and attachment.

DISCLOSURE OF THE INVENTION

The present invention relates to a tool which can perform optimally the tasks involved in wrapping gifts or scrapbooking, as well as other household or office tasks which typically require multiple tools. A tape dispenser with paper cutter is disclosed in one tool so time is not wasted finding each separate tool. The paper cutter may include paper pressure bosses which are designed to optimally slice a particular type of paper such as wrapping paper or photographic paper. Paper attachment means such as adhesive tape or a glue stick are included. Structures for curling ribbon and attaching a carrying strap may be included.

A paper cutting apparatus which can be removeably attached to a disposable tape dispenser is disclosed. This tool can also include the ribbon curler and paper pressure bosses.

A tape dispenser with paper cutter and glue stick is disclosed. The glue stick can be used as an alternate paper attaching method besides the adhesive tape. The ribbon curler and paper pressure bosses can be included in this tool.

The foregoing and other features and advantages of the present invention will be apparent from the following more detailed description of the particular embodiments of the invention, as illustrated in the accompanying drawings.

DETAILED DESCRIPTION OF EMBODIMENTS OF THE INVENTION

As discussed above, embodiments of the present invention relate to tools for office and home use and particularly to a tool for performing multiple jobs when wrapping gifts or other craft projects. Disclosed is a tape dispenser with paper cutter tool which can be used to cut and attach paper without having to use separate tools. The paper cutter can include paper pressure bosses for optimally cutting specific types of paper. The paper cutter can be removeably attached to the tool so it can be used with different tape dispensers. A glue stick can be included in the paper cutter tool as a paper attachment means.

Figure 1:
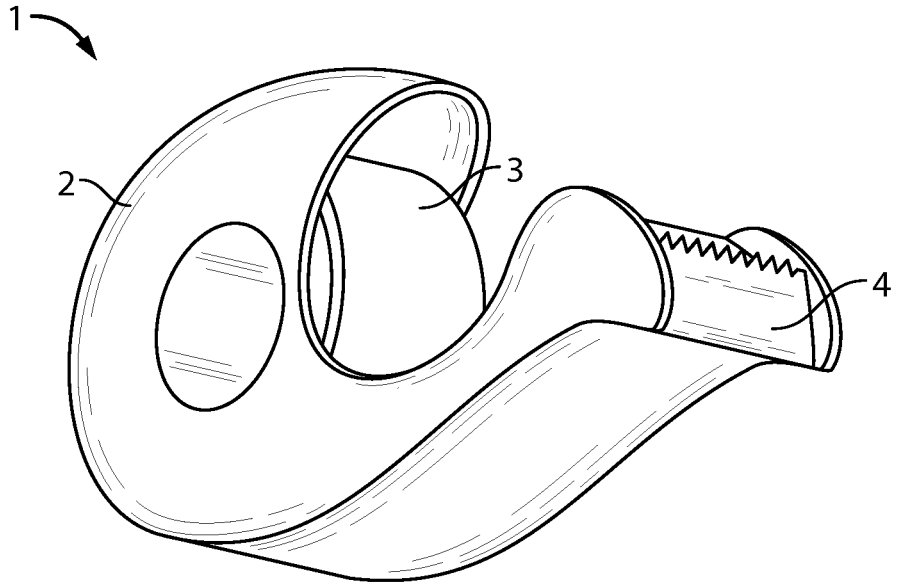
FIG. 1 (Prior Art)
FIG. 1 is a drawing of an adhesive tape dispenser.

FIG. 1 shows a prior art tape dispenser 1 having housing 2, roll of adhesive tape 3, and teeth 4 for cutting off a piece of adhesive tape. This tool performs a single task and needs to be picked up and put down each time this single task is to be performed. The tape dispenser is easily misplaced while cutting paper and time is wasted searching for the tape dispenser each time it is needed.

Figure 2:
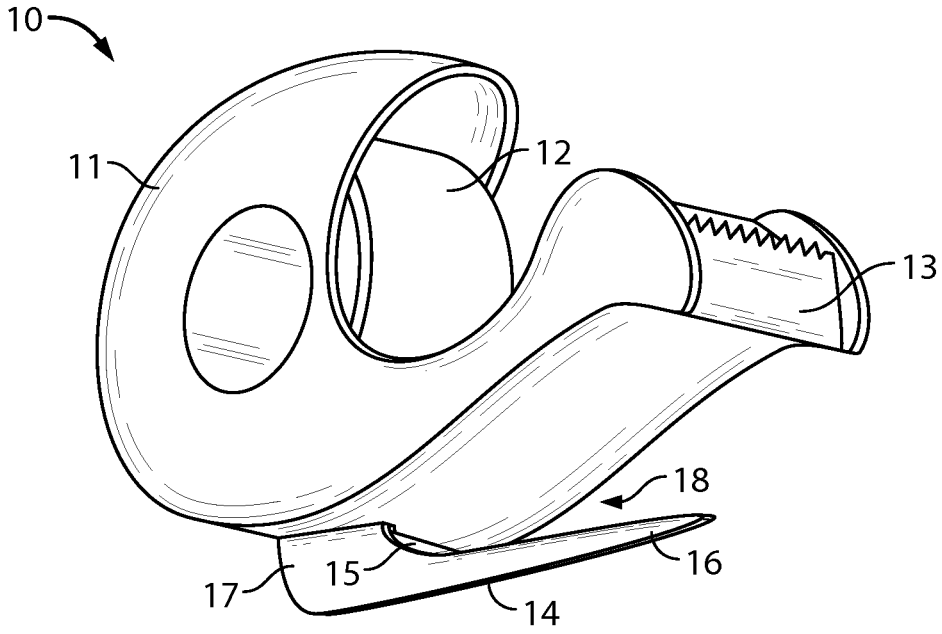
FIG. 2 is a perspective view of a tape dispenser with paper cutter in accordance with the present invention.
Figure 3:
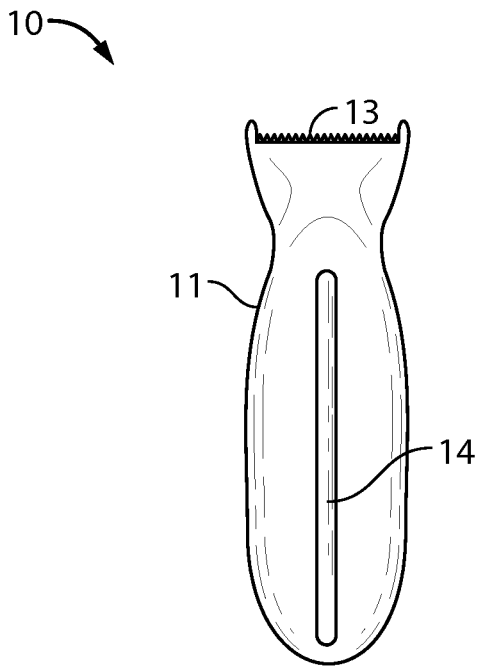
FIG. 3 is a bottom view of the tape dispenser with paper cutter of FIG. 2.
Figure 4:
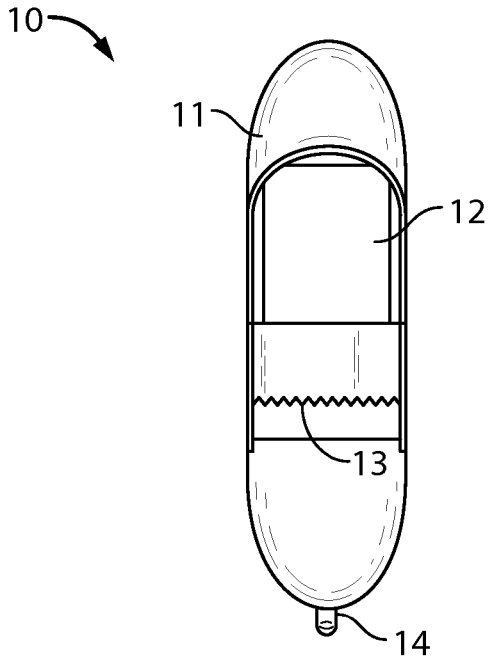
FIG. 4 is a front view of the tape dispenser with paper cutter of FIG. 2.

FIGS. 2-4 show tape dispenser with paper cutter tool 10 according to an embodiment of the present invention including housing 11, adhesive tape roll 12, tape cutting teeth 13, and paper guide tine 14. Paper guide tine 14, also called a paper guide, has an attachment end 17 attached to housing 11. Paper cutting or slicing blade 15 is mounted between tine 14 and housing 11 at attachment end 17 with a predetermined angle. Other embodiments may include a slicing blade 15 that may be of various types, such as, but not limited to a straight blade, and angled blade a circular blade and the like. Further, other embodiments may include a slicing blade 15 that is interchangeable when it becomes dull, damaged or the like. Attachment end 17 can be molded integral to the housing or attached by any means such as glue, screws, tabs and slots, etc. The distal end 16 of paper guide tine 14, which is the end opposite attachment end 17, supports wrapping paper, photographic paper, or other paper to be cut or sliced and guides it towards blade 15. When wrapping a gift, this single tool can be used to both cut the wrapping paper and supply adhesive tape for taping the wrapping paper when the gift is wrapped.

Paper guide 14 is formed such that it creates opening 18 between itself and housing 11 for sliding paper into. The paper can be slid easily back to the paper cutting or slicing blade 15 and as the tool is moved in the direction pointed to by paper guide distal end 16, the paper is cut. The tool can be guided in any direction needed to make the desired paper cut. Paper guide 14 holds the blade 15 between itself and housing 11, and blocks access to blade 15 for structures larger than the space between guide 14 and housing 11. In this way blade 15 does not cut fingers or hands or other items it is not meant to cut. The size of opening 18 can be optimized for the specific paper to be cut. A small opening 18, less than 1 mm in size can be used for single sheets of wrapping paper or office paper. A larger opening 18 of 2 mm in size can be used for cutting photographic paper or several sheets of paper. Having opening 18 optimized for the paper to be sliced helps the tool guide the paper to be sliced and minimized bunching of the thinner sheets when used with too large of an opening. The tape dispenser with paper cutter can be formed such that opening 18 is adjustable. This may be accomplished by an adjustable engagement at attachment end 17 and housing 11.

Figure 5:
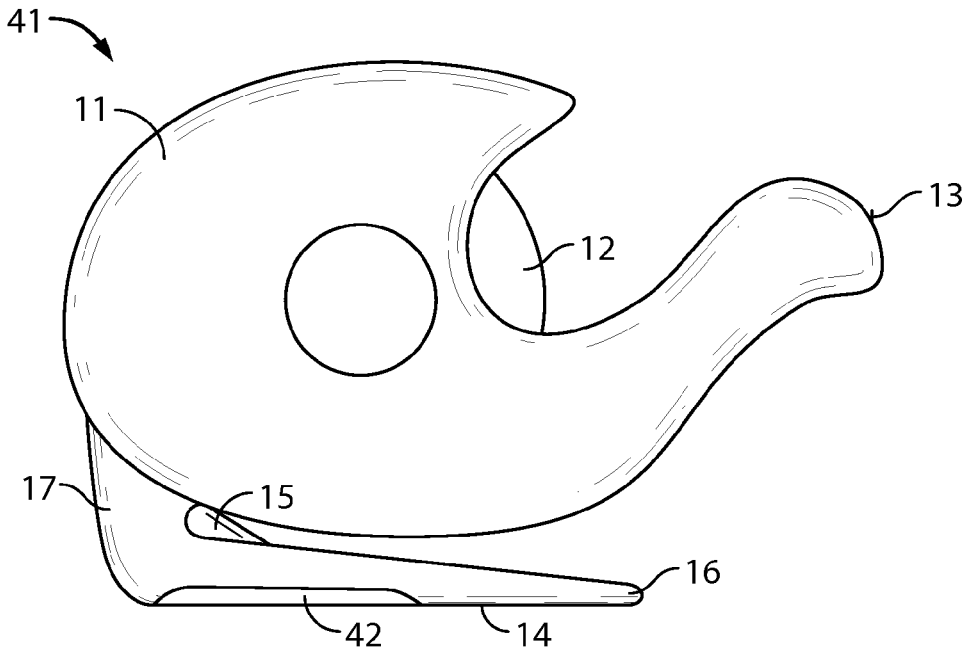
FIG. 5 is a side view of a tape dispenser with paper cutter and ribbon curler.

FIG. 5 shows tool 41 with adhesive tape roll 12 and paper cutting blade 15 and ribbon curler 42 on the outer edge of paper guide tine 14. Ribbon curler 42 is a blunt blade which is not meant for cutting but instead used for putting curls into ribbons, often used for ribbons to be put on gifts. A ribbon curl is created by holding the ribbon against blunt blade 42 and sliding the ribbon across the blade while keeping pressure on the ribbon, often with a finger. With this tool the gift wrapper can now quickly and easily cut the gift wrapping paper, tape it securely onto the gift, and tape and curl ribbons onto the gift with one tool. Ribbon curler 42 can also be used as a folding edge by holding the edge up against the paper and making a fold in the paper against the blunt edge of ribbon curler 42.

Figure 6:
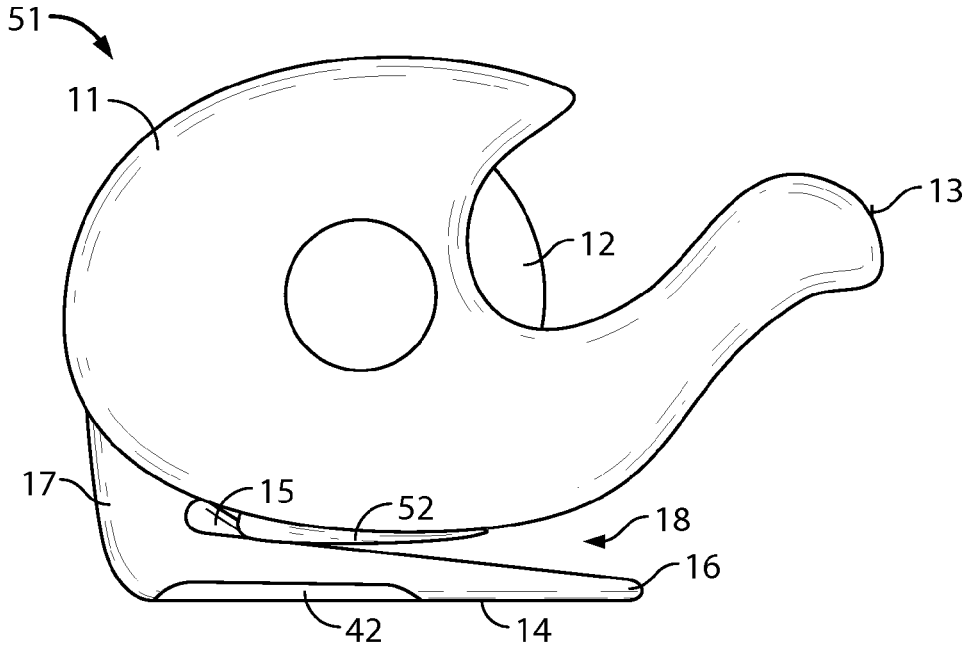
FIG. 6 is a side view of a tape dispenser with paper cutter having paper pressure bosses, and a ribbon curler.
Figure 7:
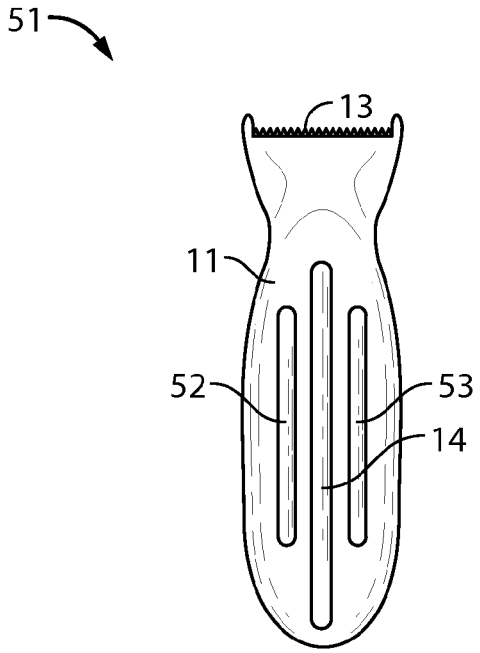
FIG. 7 is a bottom view of the present invention shown in FIG. 6.
Figure 8:
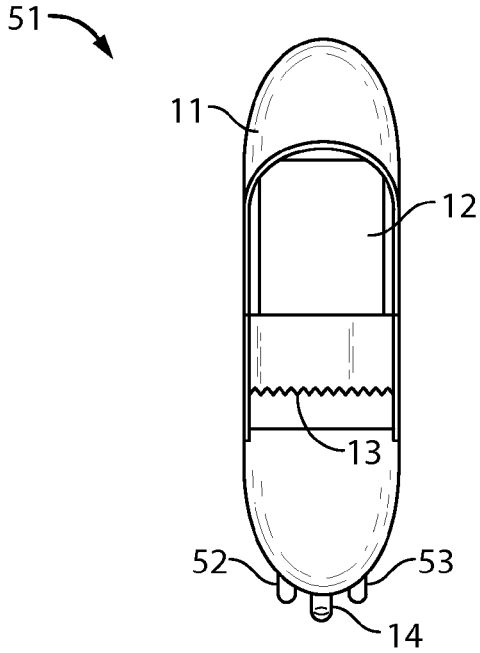
FIG. 8 is a front view of the present invention shown in FIG. 6.

FIGS. 6-8 shows tool 51, which adds paper pressure bosses 52 and 53 to the tool shown in FIG. 5. Paper pressure bosses 52 and 53 are two individual bosses mounted to housing 11 on either side of the paper guide tine 14 and which have a height greater than the size of opening 18 between the housing and the inner surface of paper guide tine 14. As the paper guide tine supports the paper to be sliced, paper pressure bosses 52 and 53 push each side of the paper away from the housing, which causes the paper to bend or fold. This helps hold the paper against blade 15 with some amount of pressure, making it easier to slice the paper. The height of the bosses can be optimally chosen for the type of paper to be used. Low bosses are better for thicker paper, higher bosses for thinner paper which can bend at a more acute angle without creasing. Further, the bosses 52 and 53 may be tapered in order to prevent paper jams.

Figure 9:
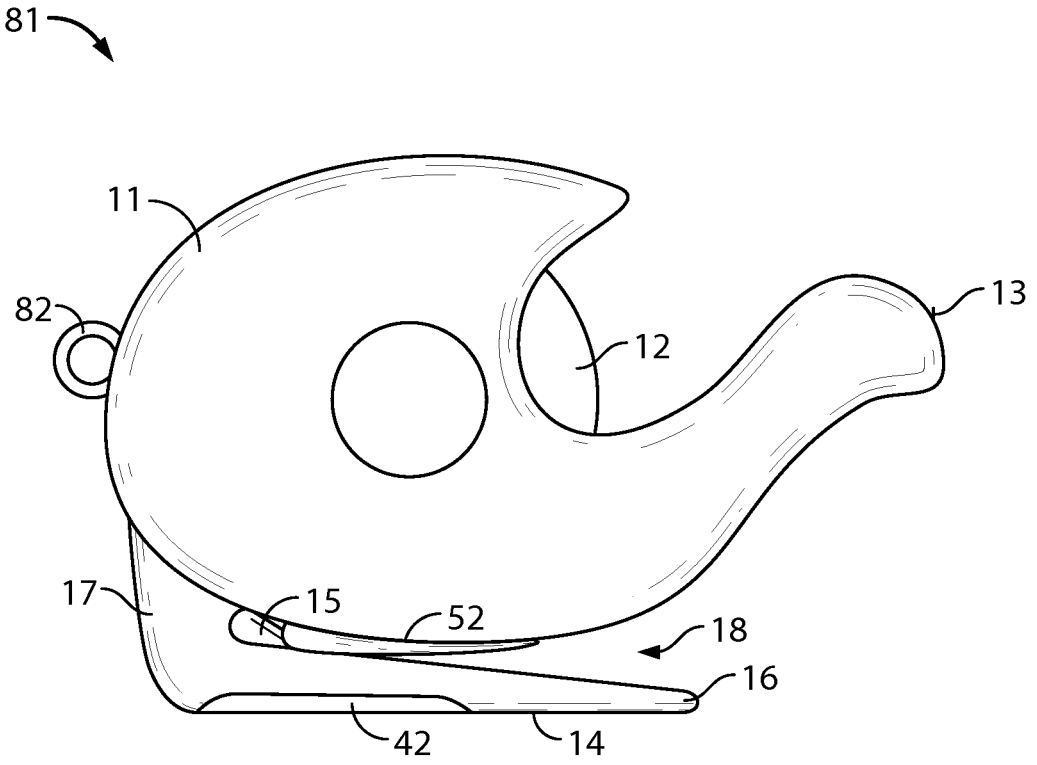
FIG. 9 is a side view of the present invention shown in FIG. 6 with an eyelet.

Tool 81 shown in FIG. 9 includes the same components shown in FIG. 6, further including eyelet 82 that can be used for attaching a carrying strap, handle, clip for hanging on a belt, or any item which can be tied or secured to the eyelet. Eyelet 82 is a hole or slot in a part of the housing or attached to the housing. A typical form of eyelet 82 is as shown in FIG. 9 which includes a semicircle joined to the housing such that the central hole is available for tying, inserting, or attaching a strap to. Eyelet 82 can take any form which provides a hole, hook, or slot.

Figure 10A:
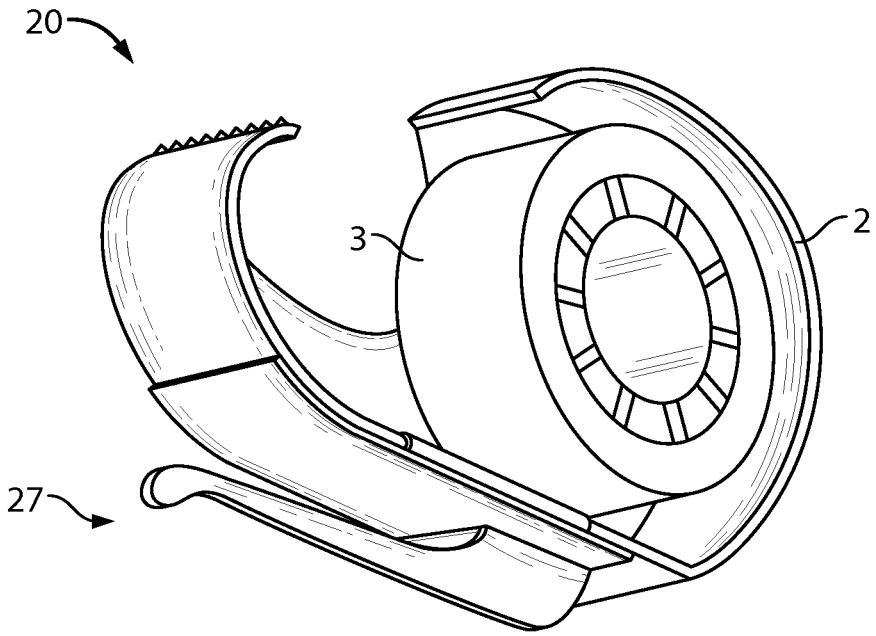
FIG. 10 is a perspective view of a paper cutter which can be removeably attached to a tape dispenser.
Figure 10B:
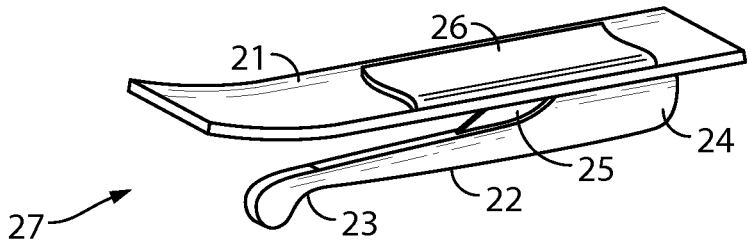
Figure 10C:
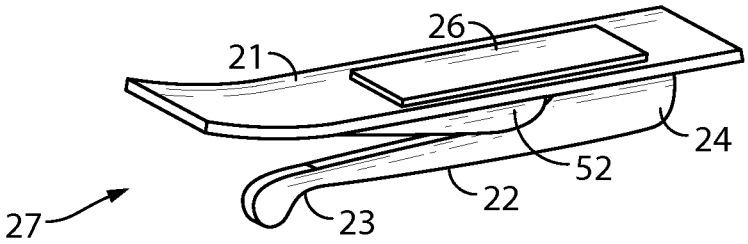

FIGS. 10A-C illustrates paper slicer 27 which can be removeably attached to disposable tape dispenser 20 or other tool. Body 21 supports paper guide tine 22 having a distal end 23 and an attachment end 24, blade 25, and clip 26. Clip 26 can be used to attach paper slicer 27 to the tool it is to be used with. Clip 26 can be any type of fastener, retainer, or connector that can be used to attach paper slicer 27 to a tape dispenser. Paper slicer 27 can be attached to disposable adhesive tape dispenser 20, in particular to housing 2, by mean of clip 26. Paper slicer 27 can optionally include a ribbon curler, paper pressure bosses, and an eyelet in any combination which is convenient for the particular use. Further, the paper slicer 27 may also include bosses, such as boss 52 in order to push each side of a paper away from the housing, which causes the paper to bend or fold. This helps hold the paper against blade 25 with some amount of pressure, making it easier to slice the paper. The height of the bosses can be optimally chosen for the type of paper to be used. Low bosses are better for thicker paper, higher bosses for thinner paper which can bend at a more acute angle without creasing. Further, the bosses 52 may be tapered in order to prevent paper jams.

Figure 13:
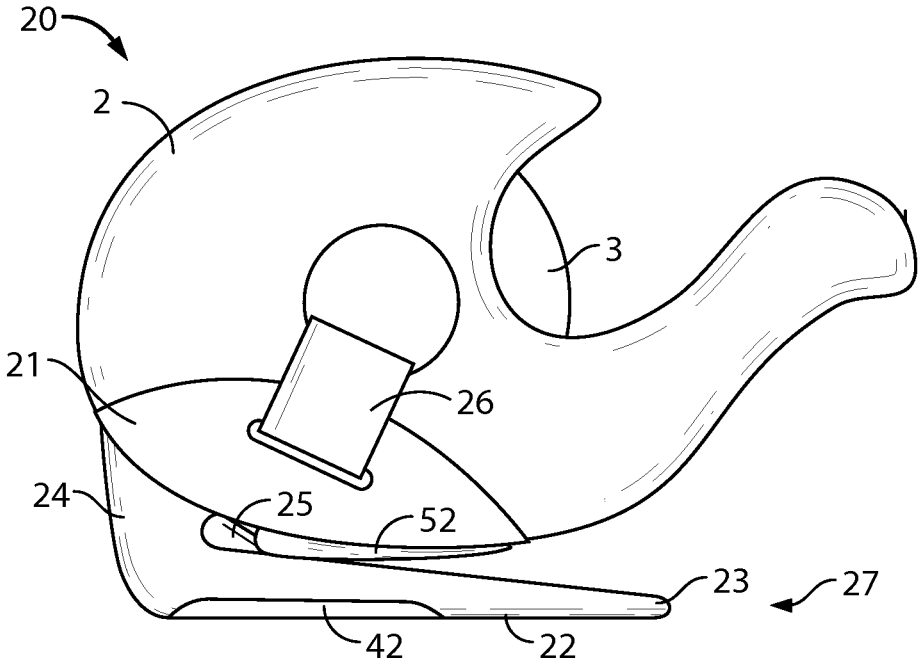
FIG. 13 is a side view of a paper cutter with a ribbon curler that can be removeably attached to a tape dispenser

FIG. 13 also illustrates another embodiment of a paper slicer 27 which can be removeable attached to disposable tape dispenser 20 or other tool. The slicer 27 includes a body 21 that supports paper guide tine 22 having a distal end 23 and an attachment end 24, blade 25, and strap 26. Strap 26 can be used to attach paper slicer 27 to the dispenser 20 is to be used with. Paper slicer 27 can be attached to disposable adhesive tape dispenser 20, in particular to housing 2, by mean of strap 26. Paper slicer 27 can optionally include a ribbon curler 42, paper pressure bosses 52, and an eyelet in any combination which is convenient for the particular use. Further, the paper slicer 27 may also include bosses, such as boss 52 in order to push each side of a paper away from the housing, which causes the paper to bend or fold. This helps hold the paper against blade 25 with some amount of pressure, making it easier to slice the paper. The height of the bosses 52 can be optimally chosen for the type of paper to be used. Low bosses are better for thicker paper, higher bosses for thinner paper which can bend at a more acute angle without creasing. Further, the bosses 52 may be tapered in order to prevent paper jams.

Figure 11:
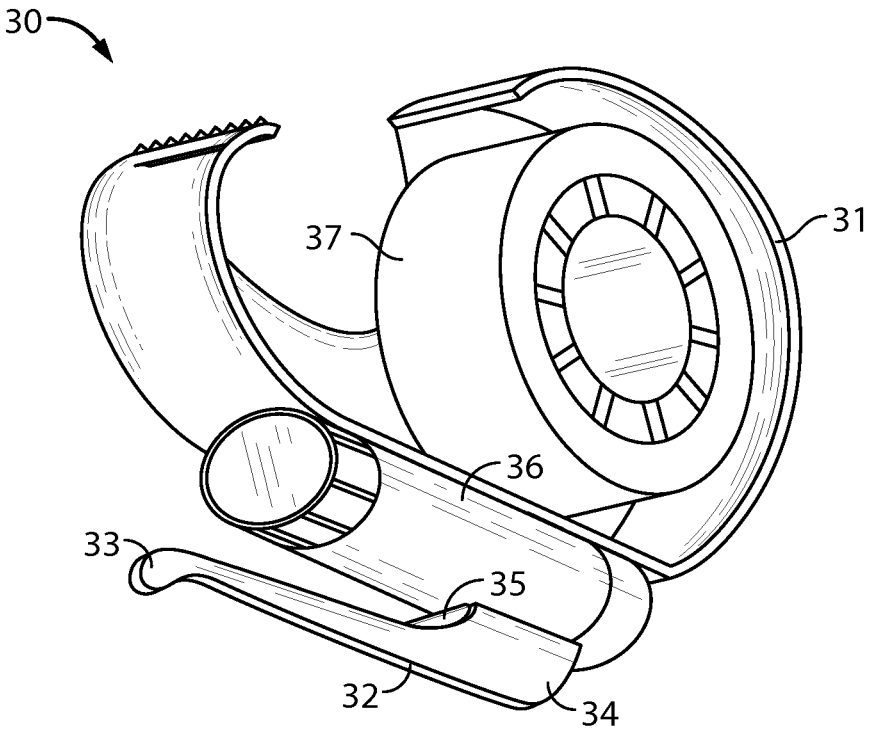
FIG. 11 is a perspective view of a tape dispenser with glue stick and paper cutter.

FIG. 11 shows tool 30, which includes tape dispenser housing 31 having integrally-formed glue stick 36, paper slicing blade 35, and paper guide tine 32. This tool allows paper attachment to be accomplished with either adhesive tape from adhesive tape roll 37 or glue from glue stick 36, and providing all the paper cutting capabilities of blade 35 and paper guide tine 32. If desired, the ribbon curler and the paper pressure bosses can be added as features to this tool.

Figure 12:
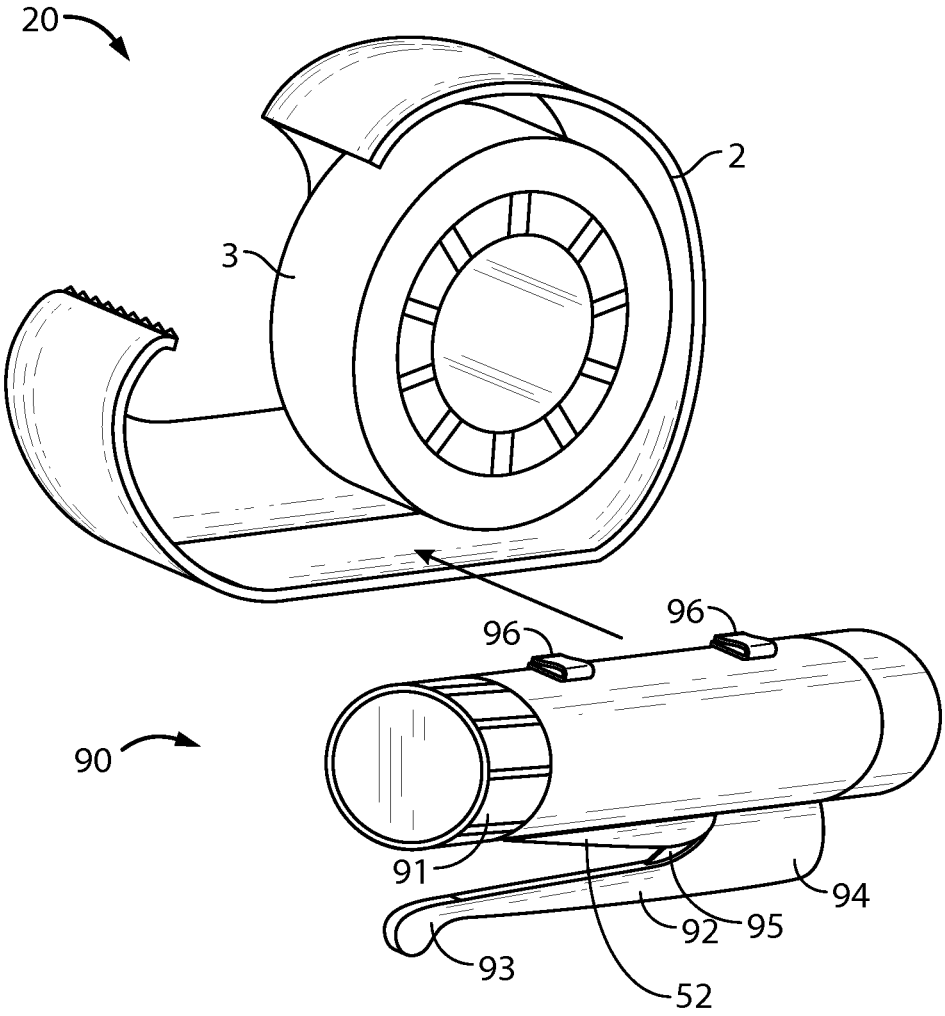
FIG. 12 is an exploded perspective view of a glue stick with paper cutter which can be removeably attached to a tape dispenser.

FIG. 12 shows tool 90 having glue stick 91 and paper guide tine 92 having a distal end 93 and an attachment end 94 and paper slicing blade 95. This embodiment can be attached to another tool using clips 96. Clips 96 can be any type of connector, fastener, or other attachment device which can attach tool 90 to another tool such as, but not limited to, a tape dispenser. Further, the tool 90 may also include bosses, such as boss 52 in order to push each side of a paper away from the housing, which causes the paper to bend or fold. This helps hold the paper against blade 95 with some amount of pressure, making it easier to slice the paper. The height of the bosses can be optimally chosen for the type of paper to be used. Low bosses are better for thicker paper, higher bosses for thinner paper which can bend at a more acute angle without creasing. Further, the bosses 52 may be tapered in order to prevent paper jams.

With further reference to FIGS. 11 and 12, while it is shown that the glue stick is coupled to a bottom portion of the tape dispensers 30 and 20 respectively, the glue stick may be coupled anywhere on the tape dispenser housing 31 and 2 respectively, such as, for example, on a curved portion of the tape dispenser housing.

The tape dispenser with paper cutter tool is used by first gathering paper and items to be cut and attached, then cutting and attaching alternatively as needed. For wrapping a gift, the gift can be placed on the wrapping paper to determine how much should be cut off. The tape dispenser with paper cutter is then be used to cut the desired length of wrapping paper. The wrapping paper can then be folded around the gift. The tape dispenser with paper cutter is then used to tape the center and ends of the wrapping paper around the gift. A desired length of ribbon is cut with the tape dispenser with paper cutter. The ribbon is wrapped around the gift and taped onto the gift using the tape dispenser with paper cutter. The ends of the ribbon are then curled using the ribbon curler portion of the tape dispenser with paper cutter. Finally a bow is attached to the gift using the tape dispenser with paper cutter.

The embodiments and examples set forth herein were presented in order to best explain the present invention and its practical application and to thereby enable those of ordinary skill in the art to make and use the invention. However, those of ordinary skill in the art will recognize that the foregoing description and examples have been presented for the purposes of illustration and example only. The description as set forth is not intended to be exhaustive or to limit the invention to the precise form disclosed. Many modifications and variations are possible in light of the teachings above without departing from the spirit and scope of the forthcoming claims. For example, the paper cutter can be made to be similar to a pair of scissors, with two opposing blades, at least one of them moveable. The tape dispenser and paper cutter housings can take different forms. One form might make for easy storage, while a different form might appeal to the fashion conscious user.

The invention claimed is:

1. A tape dispensing cutting tool comprising:

a housing for receiving and retaining a roll of adhesive tape;

a tine with a distal end and an attachment end connected to a bottom side of the housing at the attachment end; and a blade mounted to the housing and the attachment end of the tine.

2. The tool of claim 1, wherein the tine includes a ribbon curler on an outer edge.

3. The tool of claim 1, wherein a pair of bosses are mounted to the housing, adjacent to and on opposite sides of the tine, wherein a paper to be cut curves in response to the bosses.

4. The tool of claim 1, wherein an eyelet is formed in the housing.

5. The tool of claim 1 wherein the blade is mounted at a predetermined angle.

6. The tool of claim 1, further comprising an opening defined between the tine and the housing.

7. The tool of claim 1, wherein the opening is adjustable.

8. A tool comprising:

a housing for receiving and retaining a roll of adhesive tape;

a glue stick attached to a bottom side of the housing;

a tine with a distal end and an attachment end connected to the glue stick at the attachment end; and a blade mounted to the glue stick and the attachment end of the tine.

9. The tool of claim 8, wherein the tine has a ribbon curler on an outer edge.

10. The tool of claim 9, wherein a pair of bosses are mounted to the housing, adjacent to and on opposite sides of the tine, wherein a paper to be cut curves in response to the bosses.

11. The tool of claim 10, wherein an eyelet is formed in the housing.

12. The tool of claim 8, wherein the glue stick, the tine, and the blade are removeably coupled to the housing.

* * * * *